US006412739B1

(12) United States Patent
Smith

(10) Patent No.: US 6,412,739 B1
(45) Date of Patent: Jul. 2, 2002

(54) SHELF ANTI-SAGGING SUPPORT BRACE

(76) Inventor: Joel A. Smith, 74 Hailes Street, Greensborough, Victoria 3088 (AU)

( * ) Notice: Subject to any disclaimer, the term of this patent is extended or adjusted under 35 U.S.C. 154(b) by 0 days.

(21) Appl. No.: 09/653,844

(22) Filed: Sep. 1, 2000

(51) Int. Cl.[7] ..... A47G 29/00

(52) U.S. Cl. ..... 248/217.2; 248/248; 248/345.1; 52/782.23; 428/12

(58) Field of Search ..... 248/345.1, 217.2, 248/217.3, 248, 250; 108/27; 52/716.1, 823, 782.23, 782.22, 796.11, 800.12, 717.03; 428/122, 167, 168

(56) References Cited

U.S. PATENT DOCUMENTS 4,242,848 A 1/1981 Schoultz
D263,010 S 2/1982 Marsh
4,508,301 A 4/1985 Nicholson et al.
4,769,966 A 9/1988 Petri
4,830,323 A 5/1989 Harley
5,195,708 A 3/1993 Marsh

*Primary Examiner*—Korie Chan

(57) ABSTRACT

A shelf anti-sagging support brace for attachment to a side edge of a shelf to prevent the shelf from sagging or drooping. The shelf anti-sagging support brace includes an elongate member with a pair of opposite ends, and front and back side faces extending between the ends of the elongate member. The back side face of the elongate member has a pair of elongate channels therein extending between the ends of the elongate member. Each of the elongate channels is designed for receiving a side edge of a shelf therein. The channels each have a spaced apart pair of side walls, an end wall connecting the side walls of the respective channel together, and a width defined between the side walls of the respective channel. The width of one of the channels is greater than the width of the other channel.

4 Claims, 2 Drawing Sheets

15
11
28
2
10
13
2
17
18
14
19
16
12

10
15
24
17
18
13
14
27a
20
26a
22
23
19
27b
21
26b
16
25

SHELF ANTI-SAGGING SUPPORT BRACE

BACKGROUND OF THE INVENTION

1. Field of the Invention

The present invention relates to shelf anti-sagging support braces and more particularly pertains to a new shelf anti-sagging support brace for attachment to a side edge of a shelf to prevent the shelf from sagging or drooping.

2. Description of the Prior Art

The use of shelf anti-sagging support braces is known in the prior art. More specifically, shelf anti-sagging support braces heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,508,301; U.S. Pat. No. 4,242,848; U.S. Pat. No. 4,769,966; U.S. Pat. No. Des. 263,010; U.S. Pat. No. 5,195,708; and U.S. Pat. No. 4,830,323.

While these devices fulfill their respective, particular objectives and requirements, the aforementioned patents do not disclose a new shelf anti-sagging support brace. The inventive device includes an elongate member with a pair of opposite ends, and front and back side faces extending between the ends of the elongate member. The back side face of the elongate member has a pair of elongate channels therein extending between the ends of the elongate member. Each of the elongate channels is designed for receiving a side edge of a shelf therein. The channels each have a spaced apart pair of side walls, an end wall connecting the side walls of the respective channel together, and a width defined between the side walls of the respective channel. The width of one of the channels is greater than the width of the other channel.

In these respects, the shelf anti-sagging support brace according to the present invention substantially departs from the conventional concepts and designs of the prior art, and in so doing provides an apparatus primarily developed for the purpose of attachment to a side edge of a shelf to prevent the shelf from sagging or drooping.

SUMMARY OF THE INVENTION

In view of the foregoing disadvantages inherent in the known types of shelf anti-sagging support braces now present in the prior art, the present invention provides a new shelf anti-sagging support brace construction wherein the same can be utilized for attachment to a side edge of a shelf to prevent the shelf from sagging or drooping.

The general purpose of the present invention, which will be described subsequently in greater detail, is to provide a new shelf anti-sagging support brace apparatus and method which has many of the advantages of the shelf anti-sagging support braces mentioned heretofore and many novel features that result in a new shelf antisagging support brace which is not anticipated, rendered obvious, suggested, or even implied by any of the prior art shelf anti-sagging support braces, either alone or in any combination thereof.

To attain this, the present invention generally comprises an elongate member with a pair of opposite ends, and front and back side faces extending between the ends of the elongate member. The back side face of the elongate member has a pair of elongate channels therein extending between the ends of the elongate member. Each of the elongate channels is designed for receiving a side edge of a shelf therein. The channels each have a spaced apart pair of side walls, an end wall connecting the side walls of the respective channel together, and a width defined between the side walls of the respective channel. The width of one of the channels is greater than the width of the other channel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shelf anti-sagging support brace apparatus and method which has many of the advantages of the shelf anti-sagging support braces mentioned heretofore and many novel features that result in a new shelf anti-sagging support brace which is not anticipated, rendered obvious, suggested, or even implied by any of the prior art shelf anti-sagging support braces, either alone or in any combination thereof.

It is another object of the present invention to provide a new shelf anti-sagging support brace which may be easily and efficiently manufactured and marketed.

It is a further object of the present invention to provide a new shelf anti-sagging support brace which is of a durable and reliable construction.

An even further object of the present invention is to provide a new shelf anti-sagging support brace which is susceptible of a low cost of manufacture with regard to both materials and labor, and which accordingly is then susceptible of low prices of sale to the consuming public, thereby making such shelf anti-sagging support brace economically available to the buying public.

Still yet another object of the present invention is to provide a new shelf anti-sagging support brace which provides in the apparatuses and methods of the prior art some of the advantages thereof, while simultaneously overcoming some of the disadvantages normally associated therewith.

Still another object of the present invention is to provide a new shelf anti-sagging support brace for attachment to a side edge of a shelf to prevent the shelf from sagging or drooping.

Yet another object of the present invention is to provide a new shelf anti-sagging support brace which includes an elongate member with a pair of opposite ends, and front and back side faces extending between the ends of the elongate member. The back side face of the elongate member has a pair of elongate channels therein extending between the ends of the elongate member. Each of the elongate channels is designed for receiving a side edge of a shelf therein. The channels each have a spaced apart pair of side walls, an end wall connecting the side walls of the respective channel together, and a width defined between the side walls of the respective channel. The width of one of the channels is greater than the width of the other channel.

Still yet another object of the present invention is to provide a new shelf anti-sagging support brace that has two channels of different widths for receiving different thickness of shelves therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
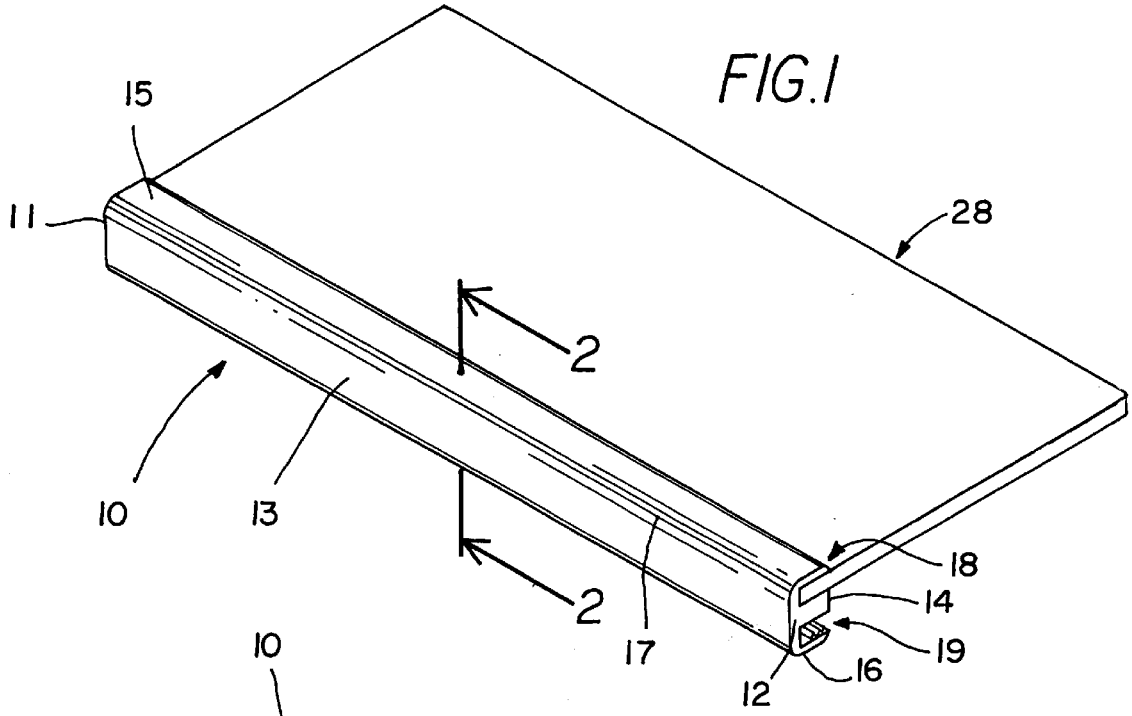
FIG. 1 is a schematic perspective view of a new shelf anti-sagging support brace according to the present invention.
Figure 2:
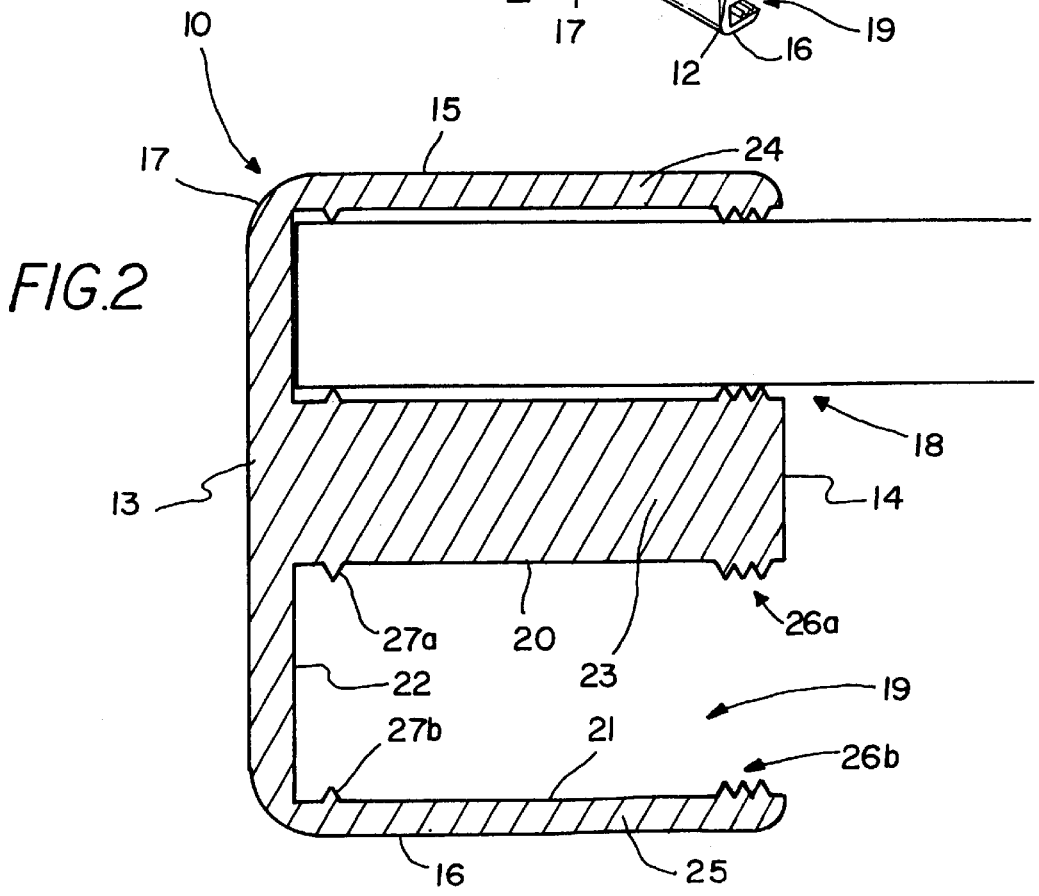
FIG. 2 is a schematic cross sectional view taken from line 2—2 of FIG. 1.
Figure 3:
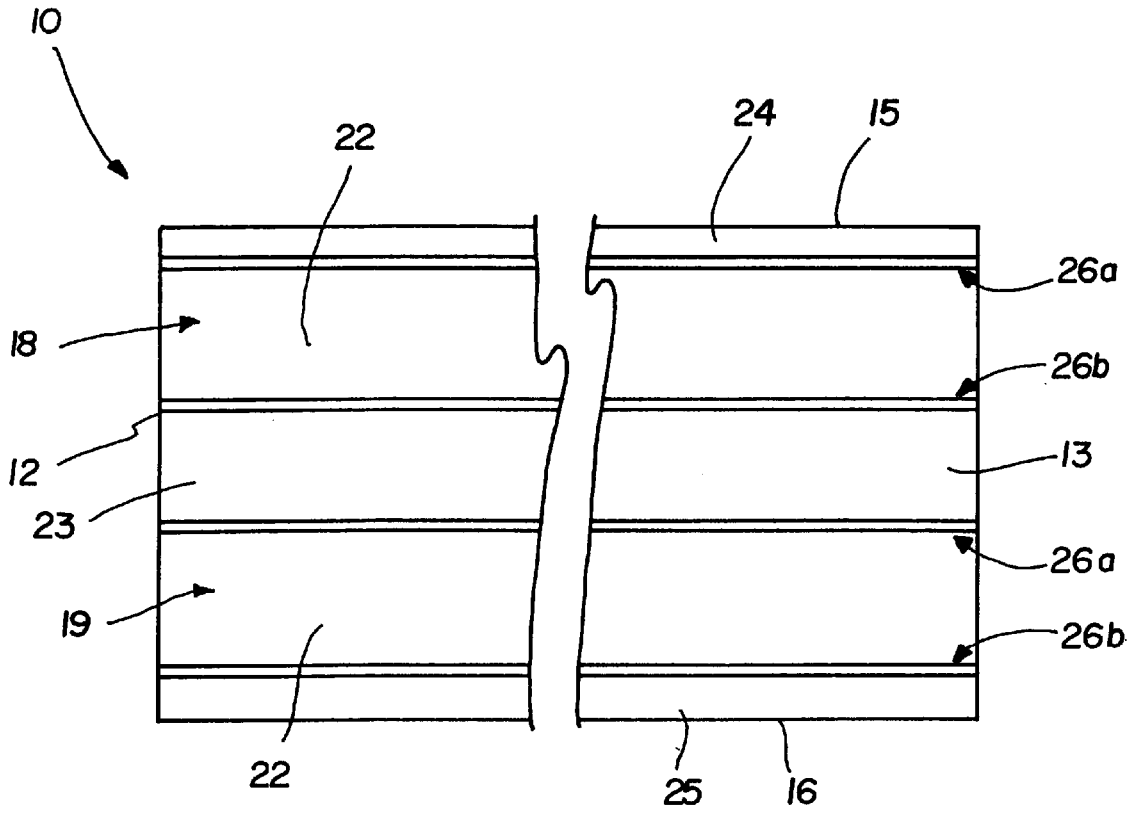
FIG. 3 is a schematic back side view of the present invention.

With reference now to the drawings, and in particular to FIGS. 1 through 3 thereof, a new shelf anti-sagging support brace embodying the principles and concepts of the present invention will be described.

As best illustrated in FIGS. 1 through 3, the shelf anti-sagging support brace generally comprises an elongate member with a pair of opposite ends, and front and back side faces extending between the ends of the elongate member. The back side face of the elongate member has a pair of elongate channels therein extending between the ends of the elongate member. Each of the elongate channels is designed for receiving a side edge of a shelf therein. The channels each have a spaced apart pair of side walls, an end wall connecting the side walls of the respective channel together, and a width defined between the side walls of the respective channel. The width of one of the channels is greater than the width of the other channel.

In closer detail, the support brace comprises an elongate member 10 having a pair of opposite ends 11,12, a longitudinal axis extending between the ends of the elongate member, and substantially planar front and back side faces 13,14 and substantially planar top and bottom faces 15,16 extending between the ends of the elongate member. For purposes of this specification, the top and bottom faces of the elongate member have been designated for aiding the understanding the description of the invention. It should be understood that the elongate member may be inverted so that the bottom face is oriented on top and the top face is oriented, on the bottom.

The elongate member may also have a plurality of rounded edges 17 extending between the ends of the elongate member. The elongate member may comprises a metal material such as an aluminum material. The elongate member may also comprise a solid (i.e., non-hollow) material.

In an illustrative embodiment, the elongate member has a length defined between the ends of the elongate member between about 1 m and about 3.6 m. In this illustrative embodiment, the elongate member has a height defined between the top and bottom faces of the elongate member of about 54 mm, and a width defined between front and back side faces of the elongate member of about 20 mm.

The back side face of the elongate member has upper and lower elongate channels 18,19 therein extending between the ends of the elongate member. The upper elongate channel is positioned towards the top face of the elongate member and the lower elongate channel is positioned towards the bottom face of the elongate member.

As best illustrated in FIG. 2, each of the channels may have a generally rectangular-U-shaped transverse cross section taken in a plane substantially perpendicular to the longitudinal axis of the elongate member. The channels each has a spaced apart pair of side walls 20,21 and an end wall 22 connecting the side walls of the respective channel together.

The side walls of the each channel may be extended substantially to each other and substantially perpendicular to the end wall of the respective channel. The side walls of the channels may also be extended substantially parallel to the top and bottom walls of the elongate member.

The end walls of the channels are positioned towards the front side face of the elongate member. The end walls of the channels may lie in a common plane with each other substantially parallel to the front and back side faces of the elongate member.

In use, each of the elongate channels is designed for receiving therein an exposed side edge of the shelf to mount the elongate member on to the exposed side edge of the shelf such that the elongate member enhances the rigidity of the shelf to prevent the shelf from sagging.

Each of the channels has a width defined between the side walls of the respective channel and a depth defined between the back side face of the elongate member and the end wall of the respective channel. The width of the lower channel may be greater than the width of the upper channel. In an illustrative embodiment, the width of the lower channel is about 18 mm and the width of the upper channel is about 16 mm to fit two different thickness of shelves therein.

The depths of the channels may equal to each other. In the illustrative embodiment, the depth of each the channel is about 17 mm so that there is a space of about 3 mm between the front side face of the elongate member and the end wall of each channel.

The channels define therebetween a middle region 23 of the elongate member. In the illustrative embodiment, the middle region may have a width defined between the channels of about 12 mm.

The upper channel and the top face of the elongate member define an upper end region 24 of the elongate member therebetween. Similarly, the lower channel and the bottom face of the elongate member define a lower end region 25 of the elongate member therebetween. The upper and lower end regions may have equal widths defined between the adjacent associated channel and face of the elongate member. In the illustrative embodiment, the width of each end region is about 3 mm.

The side walls of the channels each may have a plurality of retaining teeth 26*a*,26*b* extending into the respective channel along the lengths of the side walls between the ends of the elongate member. The retaining teeth are positioned towards the back side face of the elongate member. The retaining teeth of one side wall of each channel face the retaining teeth of the other side wall of the respective channel. In use, the retaining teeth are designed to frictionally engage an adjacently positioned associated face the shelf inserted therein to help hold the elongate member on the side edge of the shelf.

The retaining teeth each may have a generally triangular transverse cross section. In the illustrative embodiment, each retaining tooth may have a height defined outwardly from the associated side wall into the respective channel of about 0.5 mm. The retaining teeth of each side wall are arranged in a row extending in a direction between the front and back side faces of the elongate member. In the illustrative embodiment, each row of retaining teeth may include three retaining teeth.

Each channel may also have a pair of opposing stabilizing teeth 27*a*,27*b* extending therein. The stabilizing teeth each may be extended along the length of the respective channel between the ends of the elongate member. Each stabilizing tooth may also have a generally triangular transverse cross section. One stabilizing tooth of each channel is extended from one of the side walls of the respective channel and the other stabilizing tooth is extended from the other of the side walls of the respective channel.

The stabilizing teeth are spaced apart from the retaining teeth of the respective channel and positioned towards the end wall of the respective channel. In use, the stabilizing teeth are designed for abutting the adjacent associated face of the shelf inserted therein to help hold the elongate member against movement and rotation on the exposed side edge of the shelf. The stabilizing teeth may have a height equal to that of the retaining teeth of the respective channel. In the illustrative embodiment, each stabilizing tooth may have a height of about 0.5 mm.

The brace is designed for use with a planar shelf 28 that is mounted to a wall structure. The shelf has substantially planar top and bottom faces 29,30 and an elongate exposed side edge 31 outwardly facing away from the wall structure. The exposed side edge is typically one of the long side edges of the shelf.

In use, the shelf is inserted into one of the channels. The retaining teeth of this channel frictionally engage the faces of the shelf to hold the side edge of the shelf in the channel. The stabilizing teeth of this channel abut the faces of the shelf to help hold the elongate member in a fixed position of the side edge of the shelf to hold the elongate member against rotation on the side edge. The elongate member affords extra structural rigidity to the side edge of the shelf to help prevent the shelf from sagging or drooping.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shelf anti-sagging system comprising: a planar shelf; a support brace comprising:

an elongate member having a pair of opposite ends, and front and back side faces extending between said ends of said elongate member said elongate member having a length between said opposite ends;

said back side face of said elongate member having a pair of elongate channels therein extending between said ends of said elongate member, each of said elongate channels being adapted for receiving a side edge of said shelf inserted through an opening into said channel in said back side face;

each of said channels having a pair of spaced apart side walls and an end wall connecting said pair of side walls together, a width of each of said channels being defined between said side walls of said channel; and wherein said width of one of said channels is greater than said width to the other channel to accommodate different shelf thicknesses;

wherein said side walls of said channels each have a plurality of retaining teeth extending into the respective channel, said retaining teeth being positioned adjacent to said opening in said back side face of said elongate member, said retaining teeth of one side wall of each channel being positioned substantially opposite of said retaining teeth of the other side wall of the respective channel, each of said plurality of retaining teeth extending substantially continuously along said length of said elongate member; and wherein said elongate member is invertable such that during use only one of said channels engages said side edge of said shelf while the other channel is disposed below said shelf;

wherein each channel has a pair of opposed stabilizing teeth extending therein, one stabilizing tooth of each channel being extended from one of said side walls of the channel and the other stabilizing tooth being extended from the other of said side walls of the channel, each of said pair of opposed stabilizing teeth extending substantially continuously along said length of said elongate member; and wherein said stabilizing teeth of each said channel are laterally spaced apart from said retaining teeth of said channel and positioned towards said end wall of said channel such that said stabilizing teeth and said retaining teeth form laterally spaced contact points for contacting said shelf inserted into said channel.

2. The shelf anti-sagging system of claim 1, wherein said channels are extended substantially parallel to each other.

3. The shelf anti-sagging system of claim 1, wherein each of said channels of said support brace has a depth defined between said back side face of said elongate member and said end wall of the respective channel, wherein said depths of said channels are equal to each other.

4. A shelf anti-sagging system, comprising:

a support brace comprising:

an elongate member having a pair of opposite ends, a longitudinal axis extending between said ends of said elongate member, and substantially planar front and back side faces and substantially planar top and bottom faces extending between said ends of said elongate member;

said back side face of said elongate member having upper and lower elongate channels therein extending between said ends of said elongate member;

said upper elongate channel being positioned towards said top face of said elongate member and said lower elongate channel being positioned towards said bottom face of said elongate member;

each of said channels having a generally rectangular-U-shaped transverse cross section taken in a plane substantially perpendicular to said longitudinal axis of said elongate member;

each of said channels having a pair of spaced apart side walls and an end wall connecting said pair of side walls together, a width of each of said channels being defined between said side walls of said channel;

said side walls of said each channel being extended substantially parallel to each other and substantially perpendicular to said end wall of the respective channel;

said side walls of said channels being extended substantially parallel to said top and bottom faces of said elongate member;

said end walls of said channels being positioned towards said front side face of said elongate member, said end walls of said channels lying in a common plane with each other substantially parallel to said front and back side faces of said elongate member;

each of said channels having a width defined between said side walls of the respective channel and a depth defined between said back side face of said elongate member and said end wall of the respective channel;

said width of one of said channels being greater than said width of said other channel to accommodate different shelf thicknesses;

said depths of said channels being equal to each other;

wherein said side walls of said channels each have a plurality of retaining teeth extending into the respective channel, said retaining teeth being positioned adjacent to said opening in said back side face of said elongate member, said retaining teeth of one side wall of each channel being positioned substantially opposite of said retaining teeth of the other side wall of the respective channel, each of said plurality of retaining teeth extending substantially continuously along said length of said elongate member; and wherein each channel has a pair of opposed stabilizing teeth extending therein, one stabilizing tooth of each channel being extended from one of said side walls of the channel and the other stabilizing tooth being extended from the other of said side walls of the channel, each of said pair of opposed stabilizing teeth extending substantially continuously along said length of said elongate member; and wherein said stabilizing teeth of each said channel are laterally spaced apart from said retaining teeth of said channel and positioned towards said end wall of said channel such that said stabilizing teeth and said retaining teeth form laterally spaced contact points for contacting a shelf inserted into said channel;

said retaining teeth each having a generally triangular transverse cross section;

wherein each sidewalls of channels includes three of said retaining teeth;

each stabilizing tooth having a generally triangular transverse cross section;

a planar shelf having substantially planar top and bottom faces and an elongate side edge; and wherein the elongate member is invertable such that said shelf is inserted into only one of said channels, while the other channel is disposed below said shelf said retaining teeth of said one channel frictionally engaging said faces of said shelf, said stabilizing teeth of said one channel abutting said faces of said shelf.

* * * * *